US009908661B1

(12) United States Patent
Homer

(10) Patent No.: US 9,908,661 B1
(45) Date of Patent: Mar. 6, 2018

(54) CARGO SLIDE

(71) Applicant: Carey Homer, Sturgeon Lake, MN (US)

(72) Inventor: Carey Homer, Sturgeon Lake, MN (US)

(73) Assignee: Carey Denyse Homer, Sturgeon Lake, MN (US)

( * ) Notice: Subject to any disclaimer, the term of this patent is extended or adjusted under 35 U.S.C. 154(b) by 0 days.

(21) Appl. No.: 15/265,826

(22) Filed: Sep. 14, 2016

Related U.S. Application Data

(60) Provisional application No. 62/283,850, filed on Sep. 14, 2015.

(51) Int. Cl.

| | |
|---|---|
| ***B65D 19/02*** | (2006.01) |
| ***B65D 19/00*** | (2006.01) |
| ***B65D 19/38*** | (2006.01) |
| ***B65D 19/40*** | (2006.01) |

(52) U.S. Cl.
CPC ..... *B65D 19/02* (2013.01); *B65D 19/0002* (2013.01); *B65D 19/38* (2013.01); *B65D 19/40* (2013.01); *B65D 2519/0096* (2013.01); *B65D 2519/0097* (2013.01); *B65D 2519/00776* (2013.01); *B65D 2519/00781* (2013.01); *B65D 2519/00955* (2013.01)

(58) Field of Classification Search
CPC ..... B65D 2519/00776; B65D 2519/00781; B65D 2519/00786; B65D 2519/00845; B65D 2519/00855; B65D 2519/0086; B65D 2519/00935; B65D 2519/00955; B65D 2519/0096; B65D 2519/0097; B65D 19/0002; B65D 19/02; B65D 19/04; B65D 19/38; B65D 19/40
USPC ..... 108/52.1, 53.1, 53.3, 53.5, 55.1, 55.5; 248/346.01, 346.02, 346.5; 211/126.12, 211/126.2, 194, 198; 294/82.1; 280/19, 280/24; 414/559; D12/406
See application file for complete search history.

(56) References Cited

U.S. PATENT DOCUMENTS

| | | | | |
|---|---|---|---|---|
| 1,762,596 A * | 6/1930 | Soper | B42F 7/12 206/821 |
| 1,957,153 A * | 5/1934 | Smiley, Jr. | B42F 7/12 206/821 |
| 3,327,654 A * | 6/1967 | Duncan | B65D 19/12 108/53.1 |
| 3,618,899 A * | 11/1971 | Hancock, Jr. | B66D 1/28 193/35 MD |

(Continued)

*Primary Examiner* — Jonathan Liu
*Assistant Examiner* — Guang H Guan

(57) ABSTRACT

A cargo slide includes a base member, a plurality of adjustable rope members, a plurality of hook members, a plurality of accessory leg members, and a plurality of elevated members. The plurality of adjustable rope members are coupled to a plurality of attachment holes formed in the base member, such that the base member is configured to be pulled from a truck bed toward a tailgate via the plurality of adjustable rope members. The plurality of hook members are connected to the plurality of adjustable rope members, such that the cargo slide is configured to be secured in place in the truck bed when the plurality of rope members are attached to the truck bed via the plurality of hook members. The plurality of elevated members are configured to be stacked on the base member via the plurality of accessory leg members.

10 Claims, 6 Drawing Sheets

(56) References Cited

U.S. PATENT DOCUMENTS 3,779,571 A * 12/1973 Ahmling ..... B65D 19/14 280/19
3,870,151 A * 3/1975 Johnson ..... B65D 21/046 206/505
4,093,070 A * 6/1978 Stahl ..... B65D 21/046 206/507
4,106,624 A * 8/1978 Thurman ..... B65D 21/046 206/507
4,114,941 A * 9/1978 Heaton ..... B66F 9/19 280/24
4,173,351 A * 11/1979 Hetland ..... A47L 13/52 280/18
4,226,192 A * 10/1980 Myers ..... B65D 19/0018 108/53.1
4,285,529 A * 8/1981 Vaillancourt ..... B62B 17/06 280/19.1
4,320,837 A * 3/1982 Carroll ..... B65D 21/041 206/505
4,397,246 A * 8/1983 Ishida ..... B65D 19/0012 108/55.3
4,421,353 A * 12/1983 Smith, Jr. ..... B66F 9/19 294/116
4,841,880 A * 6/1989 Ferguson ..... B65D 19/0093 108/52.1
5,287,966 A * 2/1994 Stahl ..... B65D 21/041 206/503
6,135,296 A * 10/2000 Colgrove ..... A47L 15/505 211/41.8
6,543,370 B2 * 4/2003 Bae ..... B65D 19/38 108/55.1
7,686,167 B1 * 3/2010 Stahl ..... B65D 21/045 206/507
8,955,892 B1 * 2/2015 Shumate ..... B62B 15/007 280/19
9,327,868 B1 * 5/2016 Marquis ..... B65D 19/0002
9,549,659 B2 * 1/2017 Jensen ..... A47L 15/501
D793,331 S * 8/2017 Homer ..... D12/406
2004/0060844 A1 * 4/2004 Stahl ..... B65D 21/046 206/499
2004/0084387 A1 * 5/2004 Chang ..... B42F 7/12 211/11
2009/0051132 A1 * 2/2009 Masterson ..... B62B 11/00 280/19

* cited by examiner

CARGO SLIDE

CROSS-REFERENCE TO RELATED APPLICATION

This application claims the benefit of U.S. Provisional Patent Application No. 62/283,850, filed Sep. 14, 2015.

Additionally, the subject matter of this application is related to the subject matter of U.S. Non-Provisional Design patent application No. 29/505,314 filed Sep. 14, 2015.

STATEMENT REGARDING FEDERALLY SPONSORED RESEARCH OR DEVELOPMENT

There is no federally sponsored or research or development associated with this application.

THE NAMES AND PARTIES TO A JOINT RESEARCH AGREEMENT

"Not Applicable"

SEQUENCE LISTING

"Not Applicable"

PRIOR DISCLOSURES

"Not Applicable"

BACKGROUND OF THE INVENTION

The Cargo Slide is a uniquely designed truck bed accessory. Reference documents to The Cargo Slide are: U.S. Provisional Patent Application No. 62/283,850, filed Sep. 14, 2015. and U.S. Non-Provisional Design patent application No. 29/505,314 filed Sep. 14, 2015.

Other products on the market may be considered similar however, they are large, heavy, permanent/fixed metal tracks/rails that are bolted to the truck bed floor with a sliding metal tray that is attached to the tracks/rails. It moves in and out of the truck bed via the rails, going beyond the truck tailgate and take up the entire truck bed area.

FIELD OF THE INVENTION

The Cargo Slide relates to the field of truck accessories.

SUMMARY OF THE INVENTION

The Cargo Slide is a stand-alone, light-weight, portable/removable truck bed accessory. Generally, a person would have to climb up into a truck bed to off load objects that are out of reach in the truck bed. The Cargo slide allows the user to fill/load and unload the entire truck bed with objects without getting up into the truck bed.

BRIEF DESCRIPTION OF THE VIEWS OF THE DRAWINGS

There are 6 drawings in total that describe and illustrate the design and function of the Cargo Slide.

DETAILED DESCRIPTION OF THE PREFERRED EMBODIMENT

Figure 1:
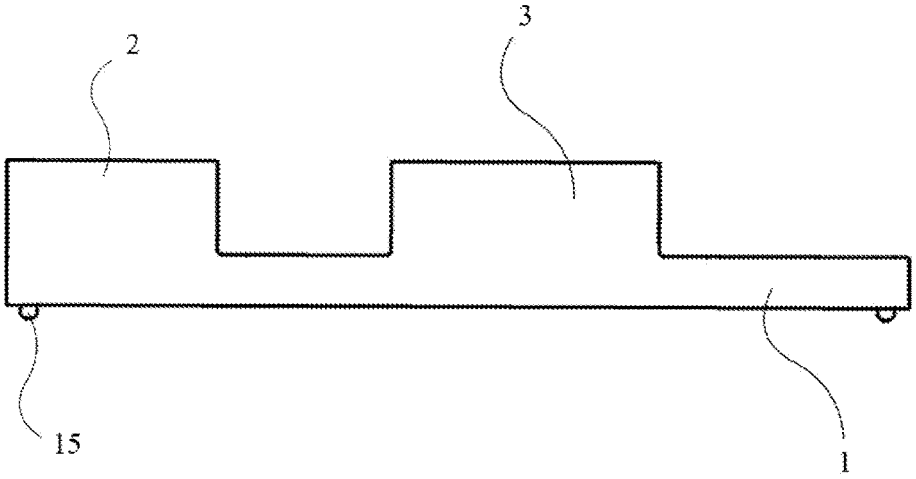
FIG. 1: the side elevation view of the Cargo Slide

FIG. 1: This side elevation view of the Cargo Slide illustration shows: #1 the Base is the main support that holds the entire cargo slide structure together. #2 the Back Wraparound Lip prevents objects from falling off the back of the Cargo Slide. #3 the Side Lips (2) prevents objects from falling off the side of the Cargo Slide. #15 the Ridge Moldings (2) appear in this view as tiny half-circles on the bottom portion of the base, help to decrease resistance/friction when pulling/pushing the Cargo Slide on the truck bed.

Figure 2:
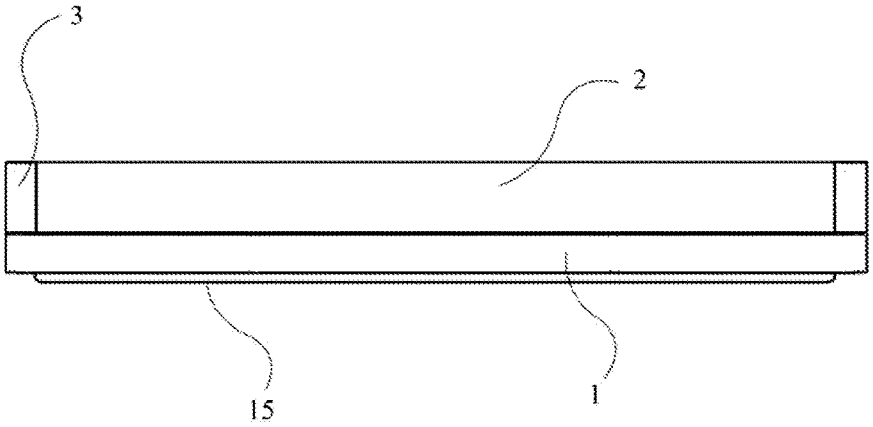
FIG. 2: the front elevation view of the Cargo Slide

FIG. 2: This front elevation view of the Cargo Slide illustration shows: #1 the Base is the main support that holds the entire cargo slide structure together. #2 the Back Wraparound Lip prevents objects from falling off the back of the Cargo Slide. #3 the Side Lips (2) prevents objects from falling off the side of the Cargo Slide. #15 the Ridge Molding (1) appears in this view as an elongated narrow oval shape on the underside portion of the Base, helps to decrease resistance/friction when pulling/pushing the Cargo Slide across the truck bed.

Figure 3:
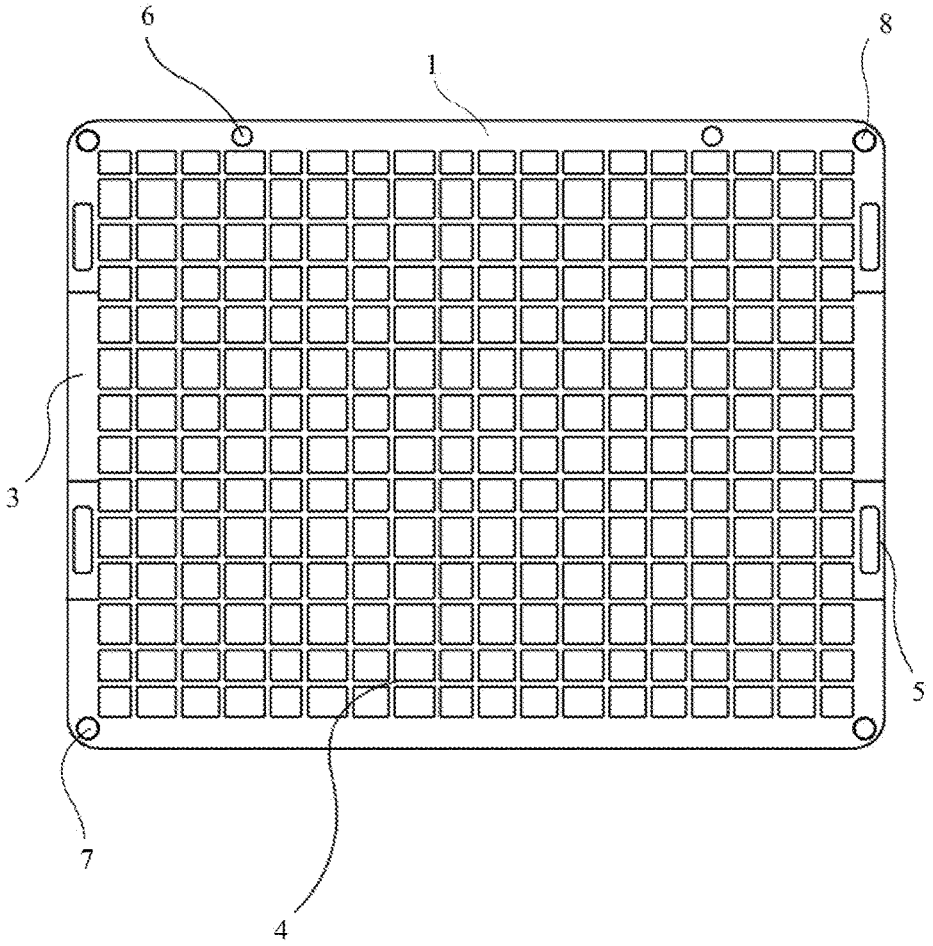
FIG. 3: the top elevation view of the Cargo Slide

FIG. 3: This top elevation view of the Cargo Slide illustration shows: #1 the Base is the main support that holds the entire Cargo Slide structure together. #3 the Side Lips (2) prevents objects from falling off the side of the Cargo Slide. #4 the Grid Platform is where objects/cargo are placed upon. #5 the Handles (4) are for 2 purposes: to carry the Cargo Slide; for a 2-person carry used for transporting objects/cargo from the truck bed to a different location and vice versa.

#6 the Rope Holes (2) are where the Taut-line Hitch Adjustable Ropes attach to the Cargo Slide. #7 the Back Wraparound Lip Holes (2) are for the Accessory Legs that support Accessory Stackable Shelves. #8 the Base Front Holes (2) are for the Accessory Legs that support Accessory Stackable Shelves.

Figure 4:
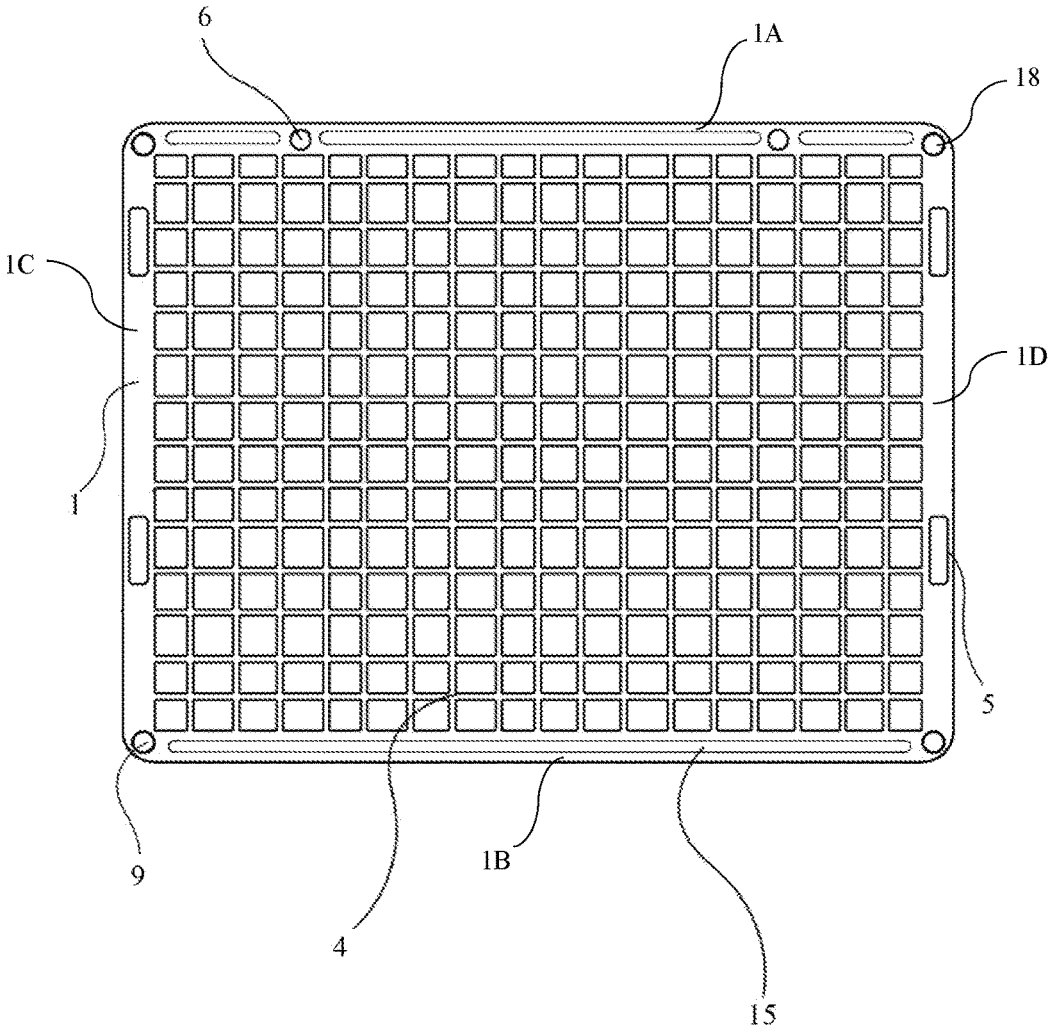
FIG. 4: the underside elevation view of the Cargo Slide

FIG. 4: The underside/bottom elevation view of the Cargo Slide illustration shows: #1 the base and main support that holds the entire Cargo Slide structure together. #1A the front base portion of the base. #1B the rear base portion of the base. #1C the first side base portion of the base. #1D the second side base portion of the base. #4 the grid platform. #5 the Handles (4) have 2 purposes: to carry the Cargo Slide; for a 2-person carry used for transporting objects/cargo from the truck bed to a different location and vice versa. #6 the rope holes (2) are where the Taut-line hitch Adjustable Ropes attach to the Cargo Slide. #9 the Base underside back holes (2). #18 the Base underside front holes (2), #15 the ridge molding (4) appears in this view as elongated narrow ovals (4) on the underside portion of the Base, helping to decrease resistance/friction when pulling/pushing the Cargo Slide on the truck bed.

Figure 5:
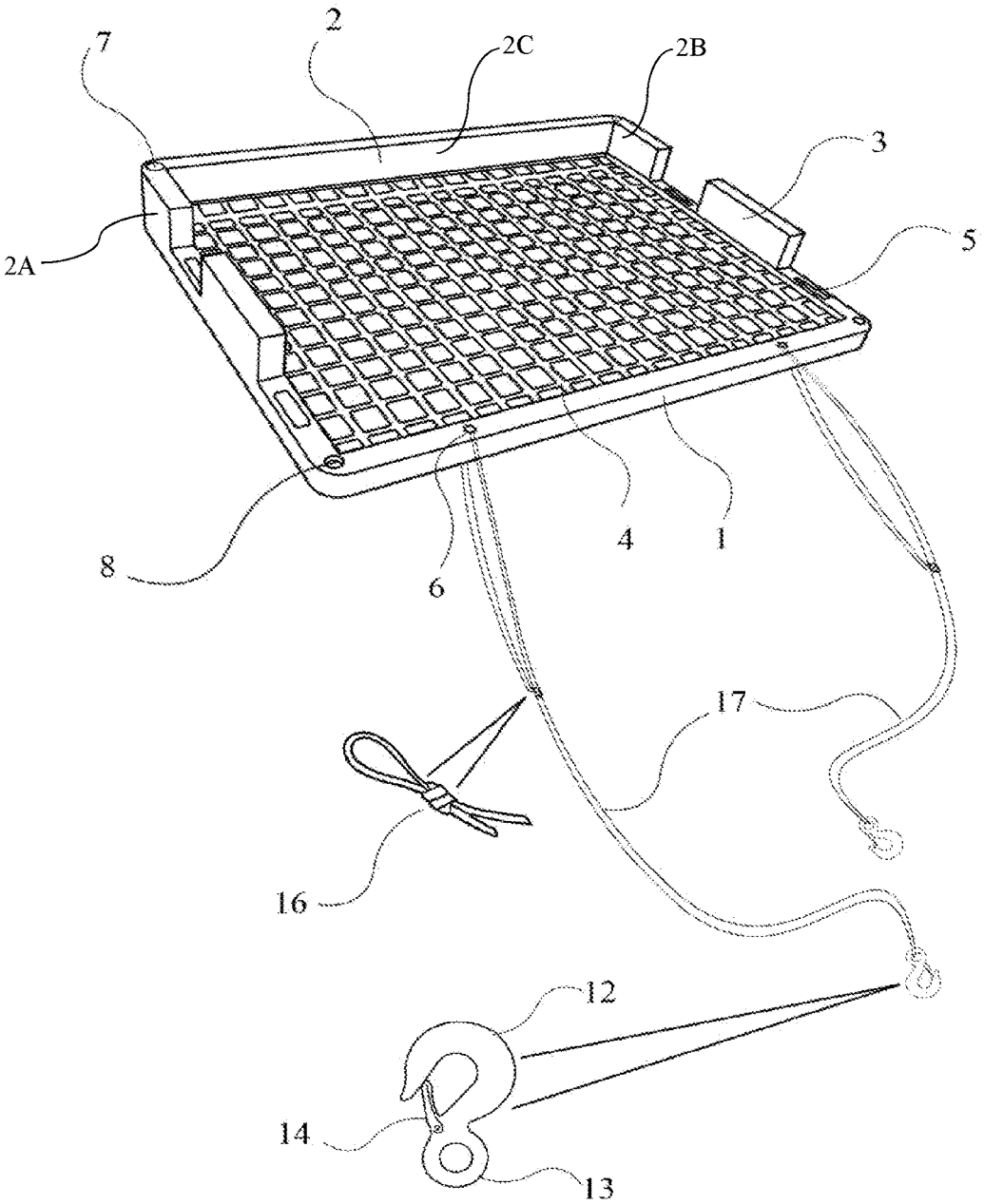
FIG. 5: the perspective elevation view of the Cargo Slide with no shelves

FIG. 5: This perspective elevation view of the Cargo Slide without shelves illustration shows: #1 the Base is the main support that holds the entire Cargo Slide structure together. #2 the Back Wraparound Lip prevents objects from falling off the back of the Cargo Slide. #2A the first lip section of the Back Wraparound Lip. #2B the second lip section of the Back Wraparound Lip. #2C the third lip section of the Back Wraparound Lip #3 the Side Lips (2) prevents objects from falling off the side of the Cargo Slide. #4 the Grid Platform is where objects are placed upon. #5 the Handles (4 per shelf) have 2 purposes: to carry the Cargo Slide; for a 2-person carry for transporting objects/cargo from the truck bed to a different location and vice versa. #6 the Rope Holes (2) are where the Taut-line Hitch Adjustable Ropes attach to the Cargo Slide. #7 the Back Wraparound Lip Holes (2) are for the Accessory Legs that support Accessory Stackable Shelves. #8 the Base Front Holes (2) are for the Accessory Legs that support Accessory Stackable Shelves. #12 the Industrial Hooks (2) are to clamp onto the truck bed welded eyelets for securing the Cargo Slide in place. #13 the Industrial Hook Loops (2) attach to the ropes. #14 the Industrial Hook Release Mechanism (2) secures the Hook. #17 the Ropes (2) are used to: secure the Cargo Slide to the bed of the truck and for the user to pull the slide toward the tailgate for easy removal of the cargo/objects.

Figure 6:
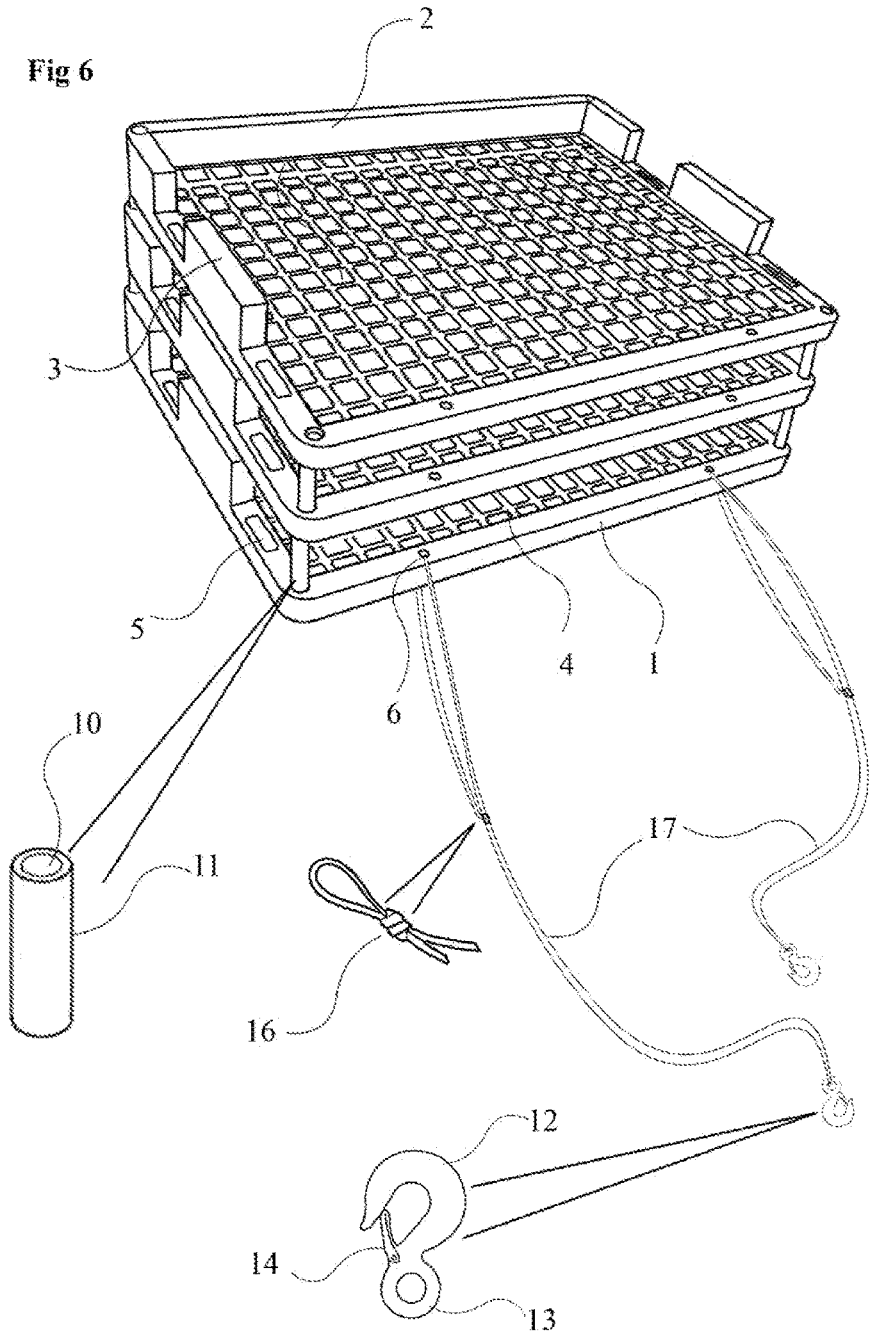
FIG. 6: the perspective elevation view with shelves

FIG. 6: This perspective elevation view of the Cargo Slide with Accessory Stackable Shelves illustration shows: #1 the Base is the main support that holds the entire Cargo Slide structure together. #2 the Back Wraparound Lip prevents objects from falling off the back of the Cargo Slide. #3 the Side Lips (2) prevents objects from falling off the side of the Cargo Slide. #4 the Grid Platform is where objects are placed upon. #5 the Handles (4) per shelf, have 2 purposes: to carry the Cargo Slide; for a 2-person carry for transporting objects/cargo from the truck bed to a different location and vice versa. #6 the Rope Holes (2) are where the Taut-line Hitch Adjustable Ropes attach to the Cargo Slide. #10 the Accessory Leg holes. #11 the exploded view of the Accessory Legs (4) per shelf are used to connect the Accessory Stackable Shelves on top of one another. #12 the exploded view of the Industrial Hooks. #13 the Industrial Hook Loops (2) attach to the Ropes. #14 the Industrial Hook Release Mechanism. #16 the exploded view of the Adjustable Taut-line Hitch Knot. #17 the Ropes (2) are used to secure the slide to the bed of the truck and for the user to pull the Cargo Slide toward the tail gate for easy removal of the cargo/objects.

DETAILED DESCRIPTION OF THE INVENTION

The Cargo Slide is a small, stand-alone, portable, light-weight truck accessory. It is a multi-purpose accessory that can hold objects in place that are in the truck bed, is great for organizing and stowing items and it allows for full utilization of the entire truck bed, making objects/cargo accessible to the user without having to crawl up into the truck bed.

The Cargo Slide is comprised of a Base unit, 2 heavy gauge nylon ropes and 2 utility hooks with the option of Accessory Shelves. The Cargo Slide Base, Accessory Legs and Accessory Shelves are made of dense polyethylene. The utility hooks are attached to the 2 nylon adjustable ropes and the ropes are secured to the Cargo Slide. The purpose of the Cargo Slide is for easy, convenient access to truck bed cargo/objects, i.e. camping, fishing, hunting, biking, skiing and most outdoor activity gear; tools, tool boxes and small machinery, paint cans and most construction materials; furniture, boxes, household items, groceries, plastic tubs, pet carriers and cages; ramps, wheelchairs and other medical equipment to name a few.

The Cargo Slide is easy to operate as follows: to load the Cargo Slide, the truck tailgate is in the down position with the Cargo Slide resting at the edge of the tailgate. The utility hooks on the ropes are clipped to the eyelets that are welded on the side walls of the truck bed.

Begin putting objects on the Cargo Slide evenly. It is recommended to put smaller, loose items or bags on the Cargo Slide first. When the Cargo Slide is full, push it into the truck bed until the Back Wraparound Lip of the Cargo Slide sits just beyond the wheel wells of the truck bed. The wheel wells will act as a guide and stabilizer for the Cargo Slide. Continue loading additional objects directly onto the truck bed surface, then using those objects, push the Cargo Slide further in toward the truck cab. Continue loading objects into the truck bed within reach and pushing, loading and pushing until the truck bed is completely full or there are no other objects to be loaded. Lastly close the tailgate.

When the user does not need to utilize the entire truck bed area, and when the Cargo Slide has reached the desired position, tighten the adjustable ropes until they are taut. This prevents the Cargo Slide from moving forward when the truck is in motion. It is recommended that when the Cargo Slide is not in use, keep the ropes hooked to the truck wall eyelets and shortened as much as possible. This will keep the empty Cargo Slide stable so that it does not move when the truck is in motion and it is in the loading position when needed.

The Cargo Slide moves easily on the truck bed surface because of the Raised Molded Ridges that are on the underside of the Cargo Slide and can easily slide under and between other truck accessories, i.e. mounted toolboxes and storage containers.

To unload the Cargo Slide, open the tailgate. Begin taking out the objects that are within reach. Simply pull the 2 ropes that are hooked to both sides of the truck walls bringing the Cargo Slide toward the tailgate: Continue offloading objects that are on the truck bed floor as they become within reach, continue alternating pulling, offloading, pulling, offloading until the truck bed and Cargo Slide are empty.

To unload a heavy or full truck load, removed the hooks/ropes from the truck eyelets and snap the hooks together. Tighten/shorten the adjustable ropes as much as possible. This will give the user the ability to pull with maximum leverage. Prior to closing the tailgate, re-clip both of the utility hooks/shortened ropes to the truck bed eyelets leaving the Cargo Slide at the tailgate end of the truck so that it is immobile and ready to reload.

The Cargo Slide is portable, light-weight and durable making it easy to remove from the truck bed if desired. It can be used as a transporting platform using 2 or more people. It can be accessorized with stackable shelves for vertical storage and better space utilization. It can be manufactured with new or recycled, non-weathered polyethylene.

The Cargo Slide can be manufactured by the rotational molding or by the injection molding processes.

The invention claimed is:

1. A cargo slide comprising:

a base member including:

a front base portion having an upper surface and a lower surface;

a rear base portion opposing the front base portion and arranged substantially parallel to the front base portion, the rear base portion having a lower surface;

a first side base portion;

a second side base portion opposing the first side base portion and arranged substantially parallel to the first side base portion;

a grid platform configured to support a cargo;

a wrap-around lip having a first lip section, a second lip section, and a third lip section arranged between the first and second lip sections, the wrap-around lip having a substantially U-shaped profile, the first lip section extending substantially perpendicularly from the first side base portion, the second lip section extending substantially perpendicularly from the second side base portion, and the third lip section extending substantially perpendicularly from the rear base portion;

a first side lip extending substantially perpendicularly from the first side base portion;

a second side lip opposing the first side lip and extending substantially perpendicularly from the second side base portion;

a front ridge molding extending from the lower surface of the front base portion;

a rear ridge molding extending from the lower surface of the rear base portion;

wherein the rust side base portion includes a plurality of first side handle openings, and the first side lip is arranged between the plurality of first side handle openings;

wherein the second side base portion includes a plurality of second side handle openings, and the second side lip is arranged between the plurality of second side handle openings;

wherein the first, second, and third lip sections of the wrap-around lip jointly define an upper lip surface with a plurality of rear support holes formed therein:

wherein the front base portion includes a plurality of front support holes formed in the upper surface of the front base portion, a plurality of front support holes formed in the lower surface of the front base portion, and a plurality of attachment holes formed in the front base portion; and wherein the rear base portion includes a plurality of rear support holes formed in the lower surface of the rear base portion;

a plurality of adjustable rope members coupled to the plurality of attachment holes formed in the front base portion of the base member, such that the cargo slide is configured to be pulled via the plurality of adjustable rope members toward a tailgate from a truck bed for removal of the cargo; and a plurality of hook members connected to the plurality of adjustable rope members, such that the cargo slide is configured to be secured in place by attaching the plurality of adjustable rope members to the truck bed via the plurality of hook members.

2. The cargo slide of claim 1, wherein each of the plurality of adjustable rope members has a first rope end and a second rope end, and each of the plurality of hook members is connected to the second rope end of a corresponding one of the plurality of adjustable rope members.

3. The cargo slide of claim 2, wherein each of the plurality of hook members includes a hook, a hook release mechanism, and a hook loop connected to the second rope end of the corresponding one of the plurality of adjustable rope members.

4. The cargo slide of claim 1, wherein each of the plurality of adjustable rope members is a heavy gauge nylon rope.

5. The cargo slide of claim 1, wherein the base member is made of polyethylene.

6. The cargo slide of claim 1, wherein each of the plurality of adjustable rope members includes an adjustable knot.

7. The cargo slide of claim 1, wherein the base member further includes two side ridge moldings extending from the lower surface of the front base portion, and the front ridge molding is arranged between the two side ridge moldings.

8. The cargo slide of claim 1, wherein the front ridge molding of the base member is arranged between the plurality of attachment holes formed in the front base portion of the base member.

9. The cargo slide of claim 1 further comprising:

a plurality of front accessory leg members;

a plurality of rear accessory leg members; and at least one elevated member including a first elevated member, each of the at least one elevated member including:

a front base portion having an upper surface and a lower surface;

a rear base portion opposing the front base portion and arranged substantially parallel to the front base portion, the rear base portion having a lower surface;

a first side base portion;

a second side base portion opposing the first side base portion and arranged substantially parallel to the first side base portion;

a grid platform configured to support the cargo;

a wrap-around lip having a first lip section, a second lip section, and a third lip section arranged between the first and second lip sections, the wrap-around lip having a substantially U-shaped profile, the first lip section extending substantially perpendicularly from the first side base portion, the second lip section extending substantially perpendicularly from the second side base portion, and the third lip section extending substantially perpendicularly from the rear base portion;

a first side lip extending substantially perpendicularly from the first side base portion;

a second side lip opposing the fast side lip and extending substantially perpendicularly from the second side base portion;

a front ridge molding extending from the lower surface of the front base portion;

a rear ridge molding extending from the lower surface of the rear base portion;

wherein the first side base portion includes a plurality of first side handle openings, and the first side lip is arranged between the plurality of first side handle openings;

wherein the second side base portion includes a plurality of second side handle openings, and the second side lip is arranged between the plurality of second side handle openings;

wherein the first, second, and third lip sections of the wrap-around lip jointly define an upper lip surface with a plurality of rear support holes formed therein;

wherein the front base portion includes a plurality of front support holes formed in the upper surface of the front base portion, a plurality of front support holes formed in the lower surface of the front base portion, and a plurality of attachment holes formed in the front base portion; and wherein the rear base portion includes a plurality of rear support holes formed in the lower surface of the rear base portion;

wherein the plurality of front accessory leg members are received in the plurality of front support holes formed in the upper surface of the front base portion of the base member and in the plurality of front support holes formed in the lower surface of the front base portion of the first elevated member, and the plurality of rear accessory leg members are received in the plurality of rear support holes formed in the upper lip surface of the wrap-around lip of the base member and in the plurality of rear support holes formed in the lower surface of the rear base portion of the first elevated member, such that the first elevated member is stacked on the base member.

10. The cargo slide of claim 9, wherein the at least one elevated member further includes a second elevated member stackable on the first elevated member.

* * * * *